US007918549B2

(12) United States Patent
Amano et al.

(10) Patent No.: US 7,918,549 B2
(45) Date of Patent: Apr. 5, 2011

(54) INK CARTRIDGE AND PRINTING APPARATUS

(75) Inventors: Kazuhiko Amano, Shibuya-ku (JP); Naoyuki Toyoda, Suwa (JP); Hiroyuki Hara, Chino (JP); Takayuki Kondo, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 977 days.

(21) Appl. No.: 11/757,051

(22) Filed: Jun. 1, 2007

(65) Prior Publication Data

US 2007/0291087 A1 Dec. 20, 2007

(30) Foreign Application Priority Data

Jun. 19, 2006 (JP) ..... 2006-169115
Apr. 10, 2007 (JP) ..... 2007-103185

(51) Int. Cl.
*B41J 2/175* (2006.01)

(52) U.S. Cl. ..... 347/86; 347/7; 347/101

(58) Field of Classification Search ..... 347/7, 19, 347/85, 86, 101
See application file for complete search history.

(56) References Cited

U.S. PATENT DOCUMENTS 5,997,121 A * 12/1999 Altfather et al. ..... 347/7
6,155,678 A 12/2000 Komplin et al.
6,302,535 B1 10/2001 Sturgeon et al.
6,325,500 B1 * 12/2001 Kitabatake et al. ..... 347/86
6,848,776 B2 2/2005 Nishioka et al.
7,445,322 B2 * 11/2008 Kitabatake et al. ..... 347/86
7,513,613 B2 4/2009 Ishizawa et al.
7,625,077 B2 12/2009 Shinada et al.
7,726,792 B2 * 6/2010 Fukushima et al. ..... 347/86
7,758,175 B2 * 7/2010 Amano et al. ..... 347/86

FOREIGN PATENT DOCUMENTS

JP A-2005-313449 11/2005
JP A 2005-313449 11/2005
WO WO 01/54910 A2 8/2001

OTHER PUBLICATIONS

Notice of Allowance issued on April 20, 2010 in U.S. Appl. No. 11/750,152, filed May 17, 2007.

* cited by examiner

*Primary Examiner* — Daniel Petkovsek
(74) *Attorney, Agent, or Firm* — Oliff & Berridge PLC

(57) ABSTRACT

An ink cartridge filled with an ink added with an infrared absorption material with a function of absorbing an infrared ray to distinguish the ink from another ink of a same color, the ink cartridge used in a loaded state where the ink cartridge is loaded into a printing apparatus for performing printing, the ink cartridge includes an ink supplying system including a storage portion for storing the ink, an outlet for supplying the ink to the printing apparatus in the loaded state, and a flow path for guiding the ink from the storage portion to the outlet, a light emitter, a sensor including a light receiver disposed in opposition to the light emitter with the ink supplying system intervened therebetween, the light receiver for receiving transmitted light resulting from transmission of emitted light from the light emitter through the ink supplying system, and an ink cartridge-side terminal electrically connected to the sensor, coming in contact with an apparatus-side terminal provided to the printing apparatus in the loaded state, in which the emitted light has a wavelength in an infrared range.

15 Claims, 10 Drawing Sheets

INK CARTRIDGE AND PRINTING APPARATUS

BACKGROUND OF THE INVENTION

1. Technical Field

Several aspects of the present invention relates to an ink cartridge and a printing apparatus.

2. Related Art

A printing apparatus such as a printer for printing a recording medium such as a paper includes a carriage, which is loaded with an ink cartridge, and a droplet discharging head, i.e., a recording head supplied with ink from the ink cartridge in a loaded state where the ink cartridge is loaded into the carriage. The droplet discharging head can discharge the aforementioned supplied ink as a droplet toward the recording medium.

As this type of ink cartridge to be loaded into printing apparatuses, for example, such as disclosed in International Publication No. 01/54910 pamphlet has been known. This known ink cartridge is provided with an outlet through which the ink is supplied from the ink cartridge to a side of the printing apparatus in a loaded state.

With this known ink cartridge, however, where the ink filled in this ink cartridge is used up, there has been the fear that the used ink cartridge is refilled through the outlet with a counterfeit ink that a manufacture such as a maker of the known ink cartridge does not guarantee the quality. The ink cartridge filled with this counterfeit ink has been used in later phase. That is, this ink cartridge has been loaded into the printing apparatus to execute printing. In the case of reuse of the ink cartridge as described above, such a problem has arisen that, for example, a nozzle of the droplet discharging head is clogged with the ink, causing poor discharging of the ink from the nozzle, or leading to an inferior printing condition of the recording medium.

SUMMARY

An advantage of the invention is to provide an ink cartridge and a printing apparatus capable of preventing the used ink cartridge to be reused by pumping the counterfeit ink unsuitable for the ink cartridge into the used ink cartridge.

According to a first aspect of the invention, an ink cartridge is filled with ink added with an infrared absorption material with a function of absorbing an infrared ray to distinguish the ink from another ink of a same color. The ink cartridge is used in a loaded state where the ink cartridge is loaded into a printing apparatus for performing printing. The ink cartridge includes: an ink supplying system; which includes: a storage portion for storing the ink; an outlet for supplying the ink to the printing apparatus in the loaded state; a flow path for guiding the ink from the storage portion to the outlet, a light emitter; a sensor which includes a light receiver disposed in opposition to the light emitter with the ink supplying system intervened therebetween; the light receiver for receiving transmitted light resulting from transmission of emitted light from the light emitter through the ink supplying system; and an ink cartridge-side terminal electrically connected to the sensor, coming in contact with an apparatus-side terminal provided to the printing apparatus in the loaded state. The emitted light has a wavelength in an infrared range.

According to this structure, the used ink cartridge can be prevented from being reused by pumping the counterfeit ink unsuitable for the ink cartridge into the used ink cartridge.

In this ink cartridge, it is preferable that the light emitter and the light receiver be disposed in opposition to each other with one part of the flow path intervened therebetween.

According to this structure, where the ink exists in the flow path, the infrared absorption material mixed into the ink certainly absorbs the infrared ray, thereby certainly decreasing the light amount of the infrared ray received by the light receiver. Where the ink does not exist in the flow path, the light amount of the infrared ray received by the light receiver is substantially equal to the light amount of the infrared ray emitted by the light emitter.

In this ink cartridge, it is preferable that an optical path of the emitted light between the light emitter and the light receiver extend in a longitudinal direction of the flow path.

According to this structure, where the ink exists in the flow path, the infrared absorption material mixed into the ink certainly absorbs the infrared ray, thereby c decreasing the light amount of the infrared ray received by the light receiver more certainly.

In this ink cartridge, it is preferable that the flow path have at least one bend in a middle thereof.

According to this structure, the ink inside the ink cartridge can be used up, i.e., run out.

In this ink cartridge, it is preferable that the outlet be open in a downward direction in the loaded state. It is also preferable that the flow path include in the loaded state, a first horizontal path extending in a substantially horizontal direction from a vicinity of a bottom of the storage portion, a first vertical path extending in a substantially vertically upward direction from an end of the first vertical path, a second horizontal path extending in a substantially horizontal direction from an upper portion of the first vertical path, and a second vertical path extending in a substantially vertically downward direction from an end of the second horizontal path up to the outlet.

According to this structure, the ink inside the ink cartridge can be used up, i.e., run out.

In this ink cartridge, it is preferable that the light emitter and the light receiver be disposed in opposition to each other with the second horizontal path intervened therebetween in a longitudinal direction of the second horizontal path.

According to this structure, where the ink exists in the second horizontal path, the infrared absorption material mixed into the ink certainly absorbs the infrared ray, thereby decreasing the light amount of the infrared ray received by the light receiver more certainly.

In this ink cartridge, it is preferable that the emitted light have a peak wavelength within 750 to 1500 nm.

According to this structure, the infrared ray can be certainly absorbed by the infrared absorption material mixed into the ink.

In this ink cartridge according to the first aspect of the invention, it is preferable that the infrared absorption material include as a main material at least one kind of a phthalocyanine-based dye, a naphthalocyanine-based dye, and an anthraquinone-based dye.

According to this structure, the infrared ray can be certainly absorbed.

According to a second aspect of the invention, a printing apparatus performs printing in a loaded state where the printing apparatus is loaded with the ink cartridge according to the first aspect of the invention. The printing apparatus includes: a loaded portion loaded with the ink cartridge; which includes an apparatus-side terminal in contact with an ink cartridge-side terminal in the loaded state; a droplet discharging head for discharging as a droplet the ink supplied from the ink cartridge in the loaded state; and a controller electrically connected to the apparatus-side terminal, the controller having a function of controlling a droplet discharging operation of the droplet discharging head. The controller makes a judgment as to adequacy of use of the ink inside the ink cartridge based on information form the sensor. The controller prohibits printing operation in the case of the judgment that the use of the ink is inadequate.

According to this structure, the used ink cartridge can be prevented from being reused by pumping the counterfeit ink unsuitable for the ink cartridge into the used ink cartridge.

According to a third aspect of the invention, a printing apparatus performs printing in a loaded state where the printing apparatus is loaded with an ink cartridge filled with an ink containing an infrared absorption material with a function of absorbing an infrared ray to distinguish the ink from another ink of a same color. The ink cartridge includes a flow path allowing the ink to pass therethrough. The printing apparatus includes: a loaded portion loaded with the ink cartridge; which includes an apparatus-side terminal in contact with an ink cartridge-side terminal in the loaded state; a light emitter; a sensor including a light receiver disposed in opposition to the light emitter with the flow path intervened therebetween; the light receiver for receiving transmitted light resulting from transmission of emitted light from the light emitter through the flow path; a droplet discharging head for discharging as a droplet the ink supplied from the ink cartridge in the loaded state; and a controller electrically connected to the apparatus-side terminal. The controller has a function of controlling a droplet discharging operation of the droplet discharging head. The emitted light includes light with a wavelength in an infrared range. The controller makes a judgment as to adequacy of use of the ink inside the ink cartridge based on information form the sensor. The controller prohibits printing operation in the case of the judgment that the use of the ink is inadequate.

According to this structure, the used ink cartridge can be prevented from being reused by pumping the counterfeit ink unsuitable for the ink cartridge into the used ink cartridge.

In this printing apparatus, it is preferable that the controller make the judgment as to adequacy of the use of the ink inside the ink cartridge according to the light amount of the transmitted light received by the light receiver.

According to this structure, the used ink cartridge can be prevented from being reused by pumping the counterfeit ink unsuitable for the ink cartridge into the used ink cartridge.

In this printing apparatus, it is preferable that the controller control to prohibit the printing operation where the light amount is greater than or equal to a predetermined value previously set.

According to this structure, the used ink cartridge can be prevented from being reused by pumping the counterfeit ink unsuitable for the ink cartridge into the used ink cartridge.

In this printing apparatus, it is preferable that the controller control to perform the printing operation where the light amount is smaller than the predetermined value.

According to this structure, the printing operation can be certainly performed using the ink cartridge filled with the ink mixed with the infrared absorption material.

In this printing apparatus, it is preferable that the controller count the number of print dots where the light amount reaches to the predetermined value.

According to this structure, the ink can be certainly used up, i.e., run out.

In this printing apparatus, it is preferable that the controller control to suspend the printing operation where the counted number of the print dots reaches the predetermined number of dots previously set.

According to this structure, the ink can be certainly used up, i.e., run out.

In this printing apparatus, it is preferable that the printing apparatus further include a reporting unit for reporting exchange of the ink cartridge in the case of prohibition or suspension of the printing operation.

According to this structure, necessity of exchange or timing of exchange of the ink cartridge can be confirmed.

In this printing apparatus, it is preferable that the emitted light have the maximum wavelength within 750 to 1500 nm.

According to this structure, the infrared ray can be certainly absorbed by the infrared absorption material mixed into the ink.

In this printing apparatus, it is preferable that the infrared absorption material include as a main material at least one kind of a phthalocyanine-based dye, a naphthalocyanine-based dye, and an anthraquinone-based dye.

According to this structure, the infrared ray can be certainly absorbed.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, an ink cartridge and a printing apparatus of this invention will be described in detail based on preferred embodiments shown in accompanying drawings.

First Embodiment

Figure 1:
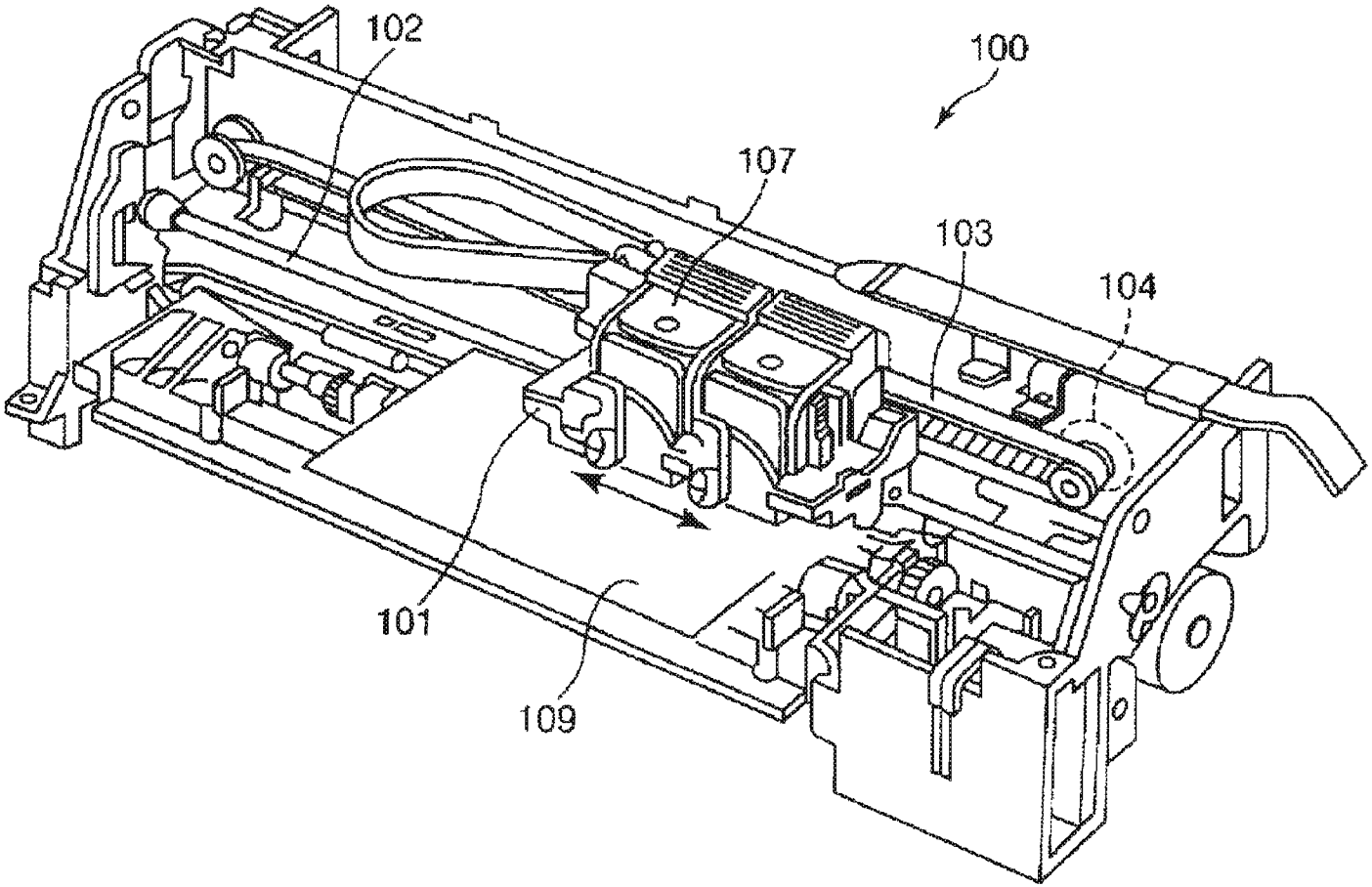
FIG. 1 is a perspective view showing a printing apparatus according to a first embodiment of this invention.
Figure 2A:
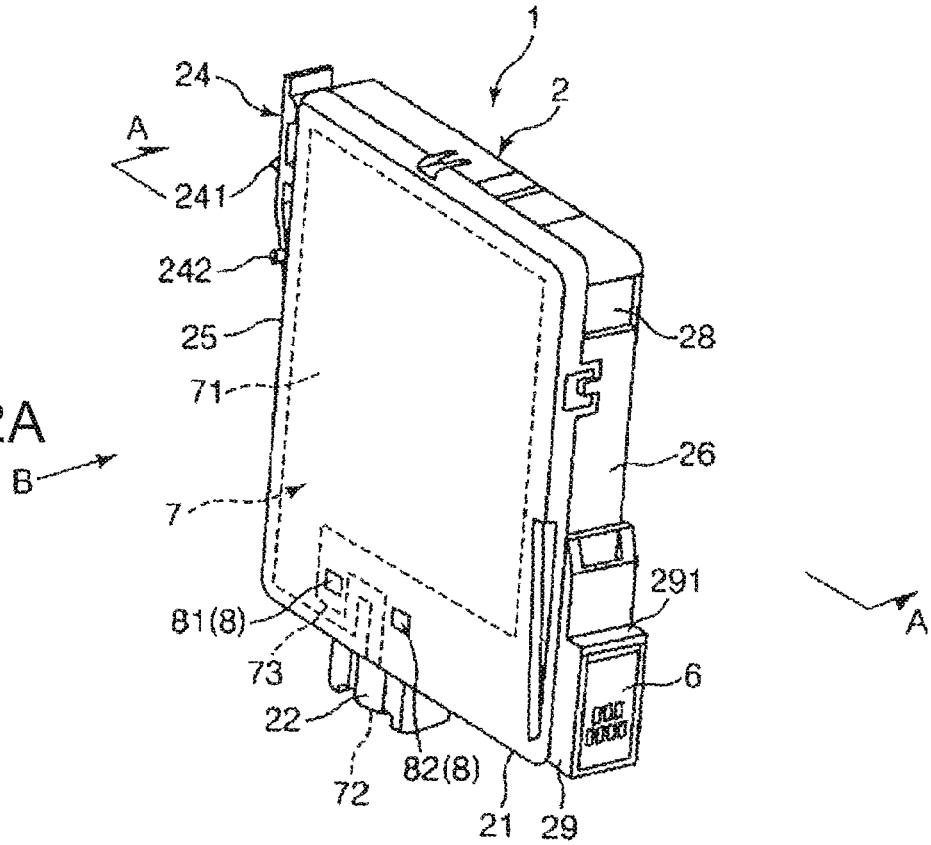
FIG. 2A is a perspective view showing an ink cartridge loaded into the printing apparatus shown in FIG. 1.
Figure 2B:
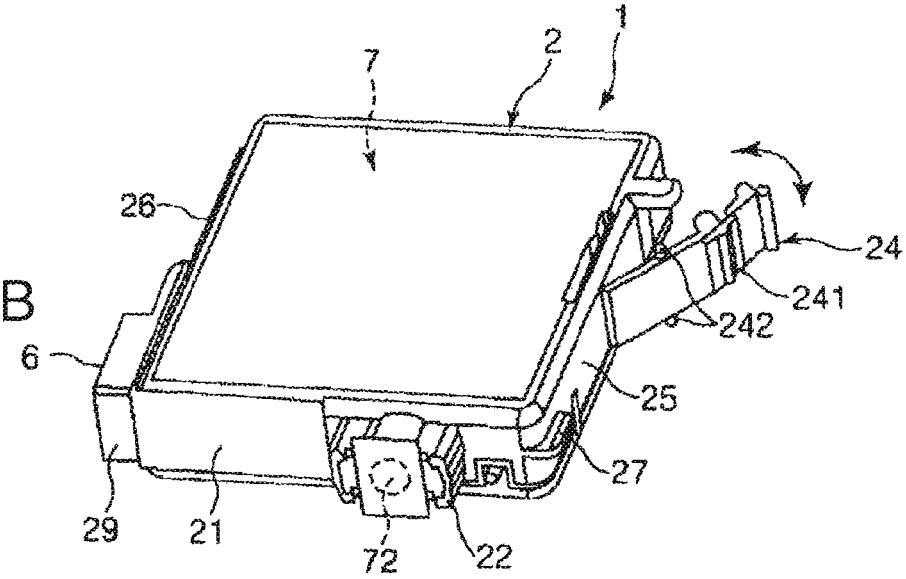
FIG. 2B is a perspective view showing the ink cartridge loaded into the printing apparatus shown in FIG. 1.
Figure 3:
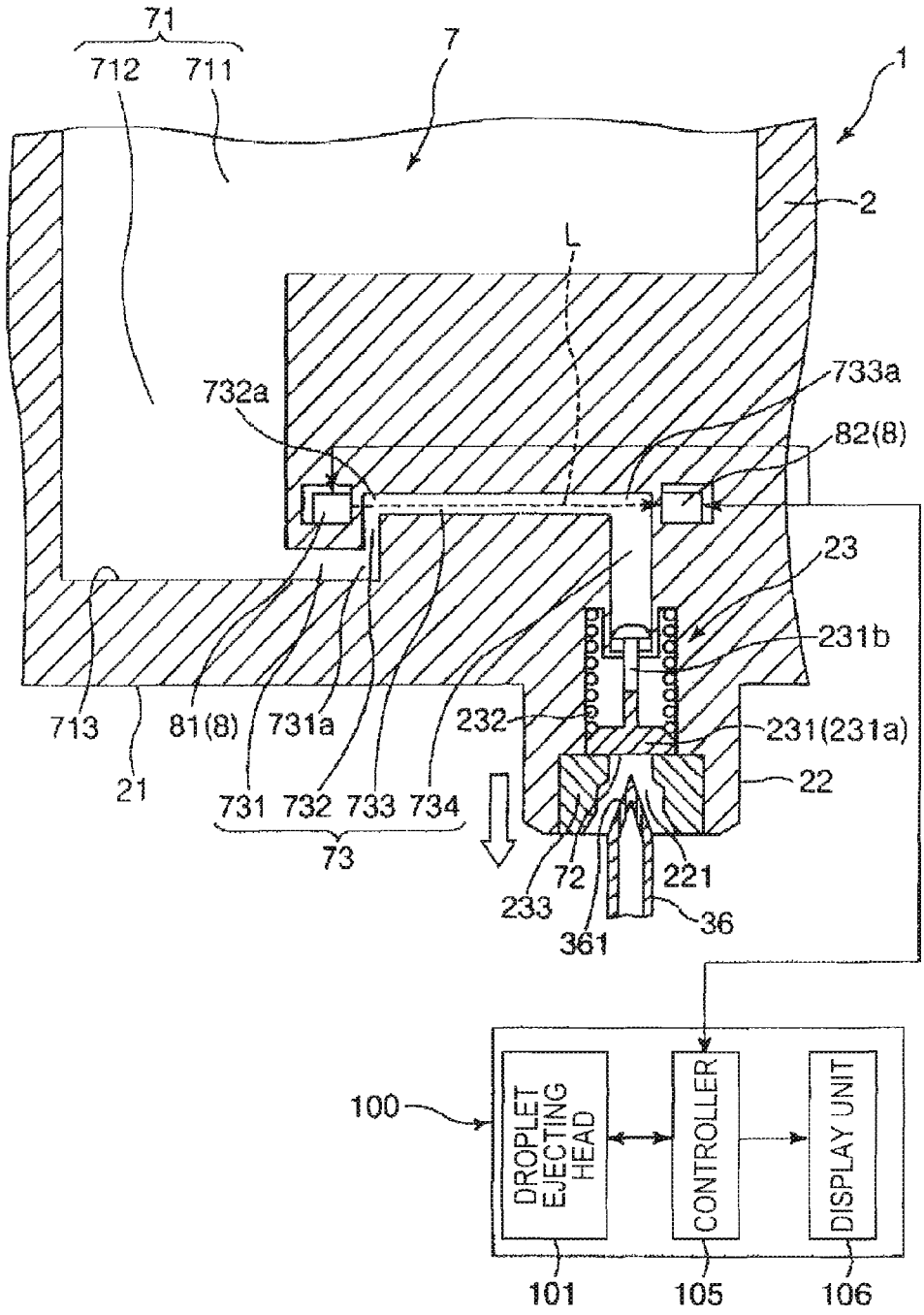
FIG. 3 is a cross-sectional view of the ink cartridge along the line A-A in FIG. 2A.
Figure 4A:
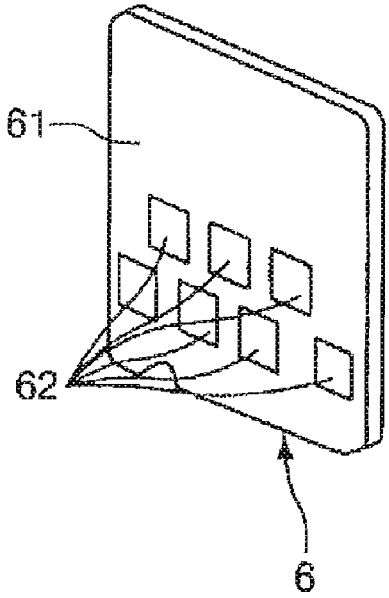
FIG. 4A is a perspective view showing ink-cartridge-side terminals included in the ink cartridge shown in FIGS. 2A and 2B.
Figure 4B:
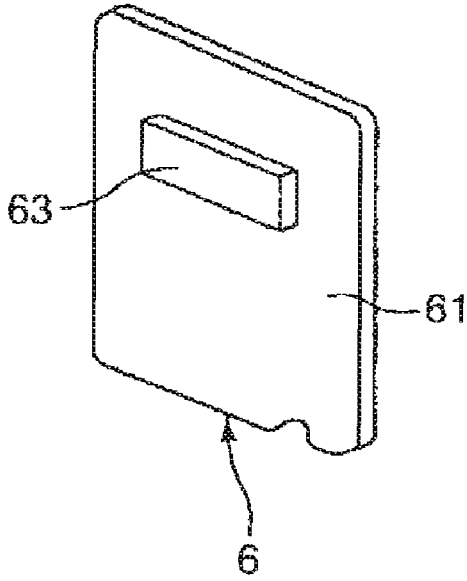
FIG. 4B is a perspective view showing a terminal-integrated portion included in the ink cartridge shown in FIGS. 2A and 2B.
Figure 5:
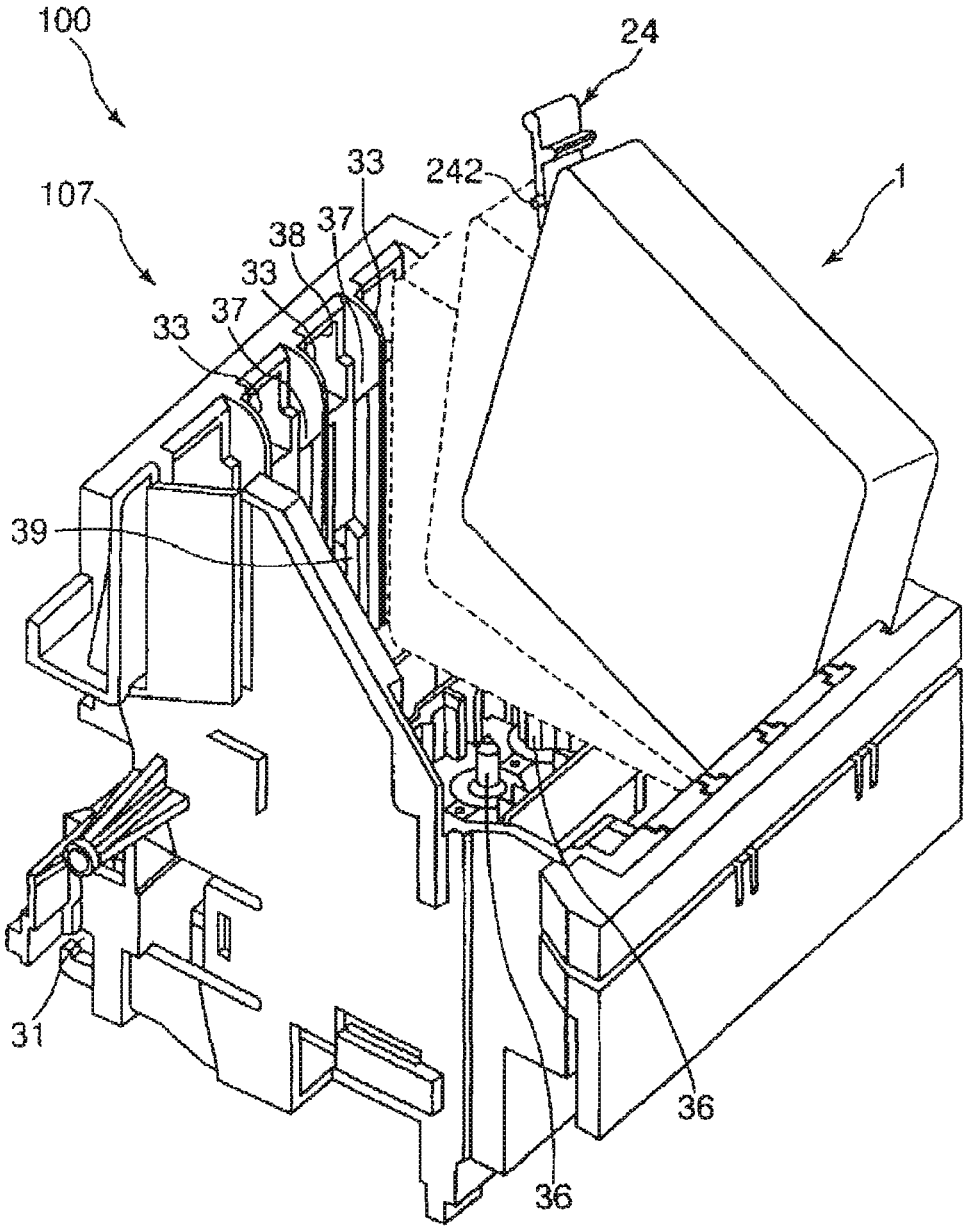
FIG. 5 is a perspective view of a droplet discharging head of the printing apparatus shown in FIG. 1.
Figure 6:
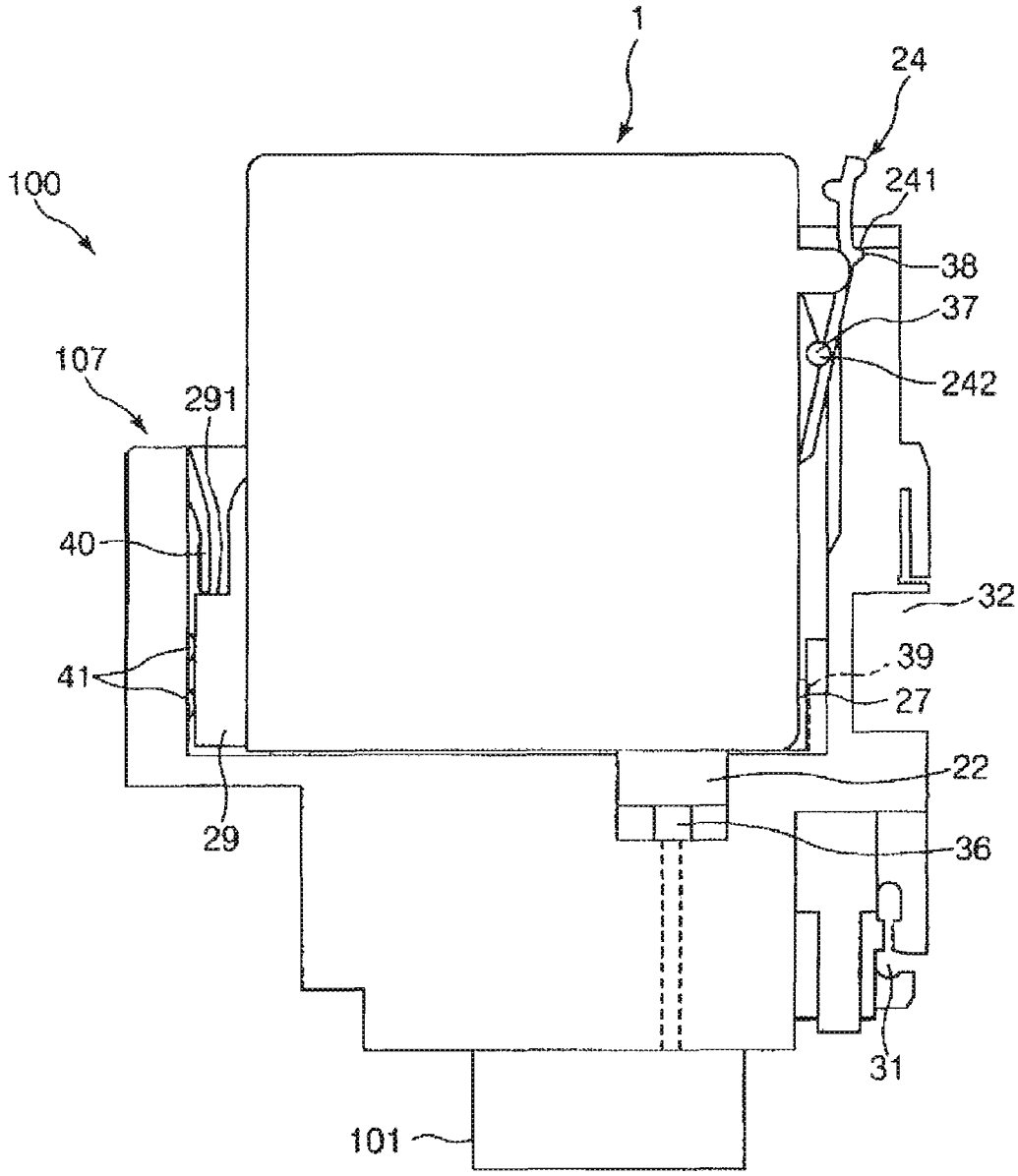
FIG. 6 is a side view of the droplet discharging head shown in FIG. 5.
Figure 7:
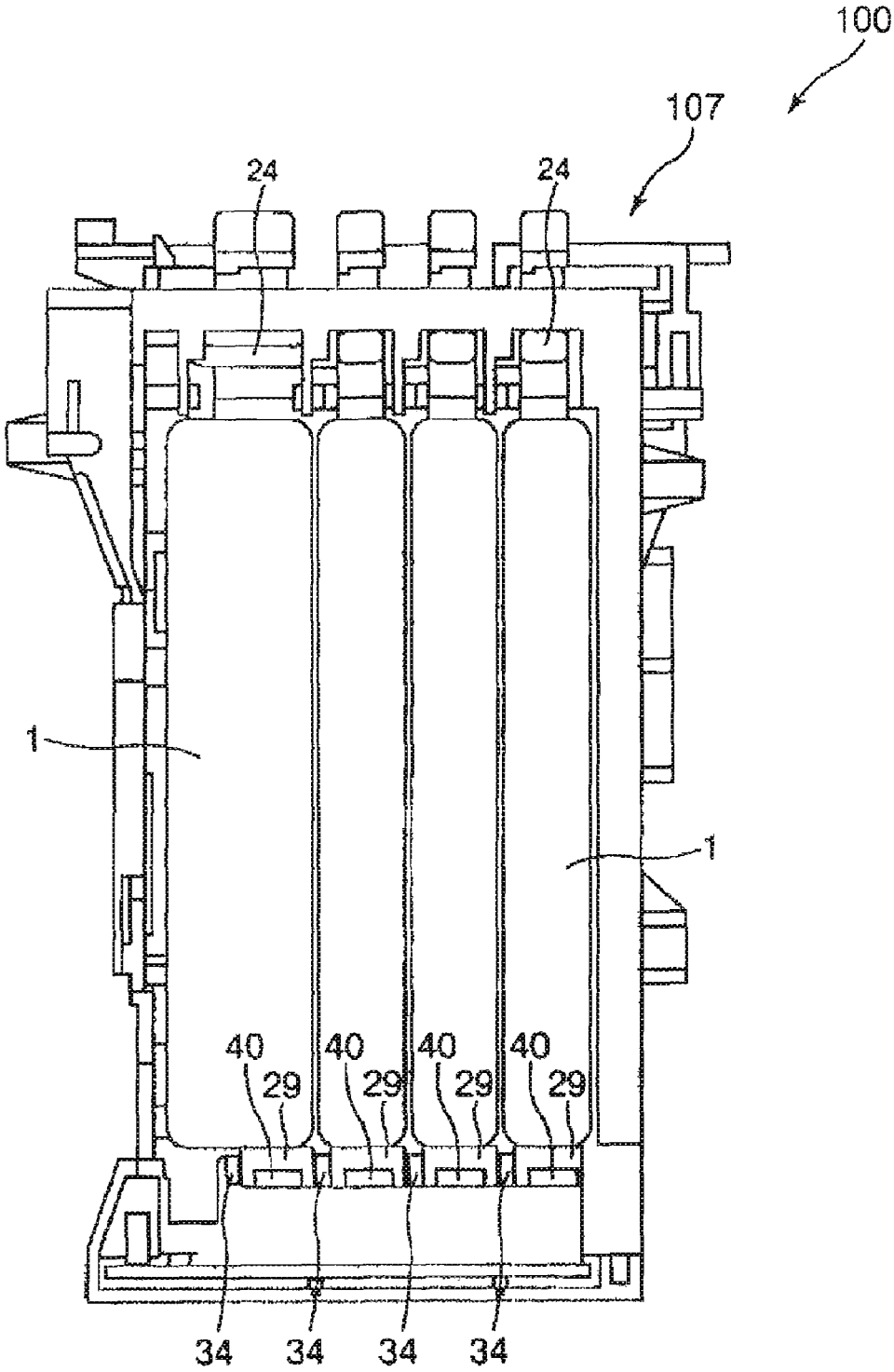
FIG. 7 is a plan view of the droplet discharging head shown in FIG. 5.
Figure 8:
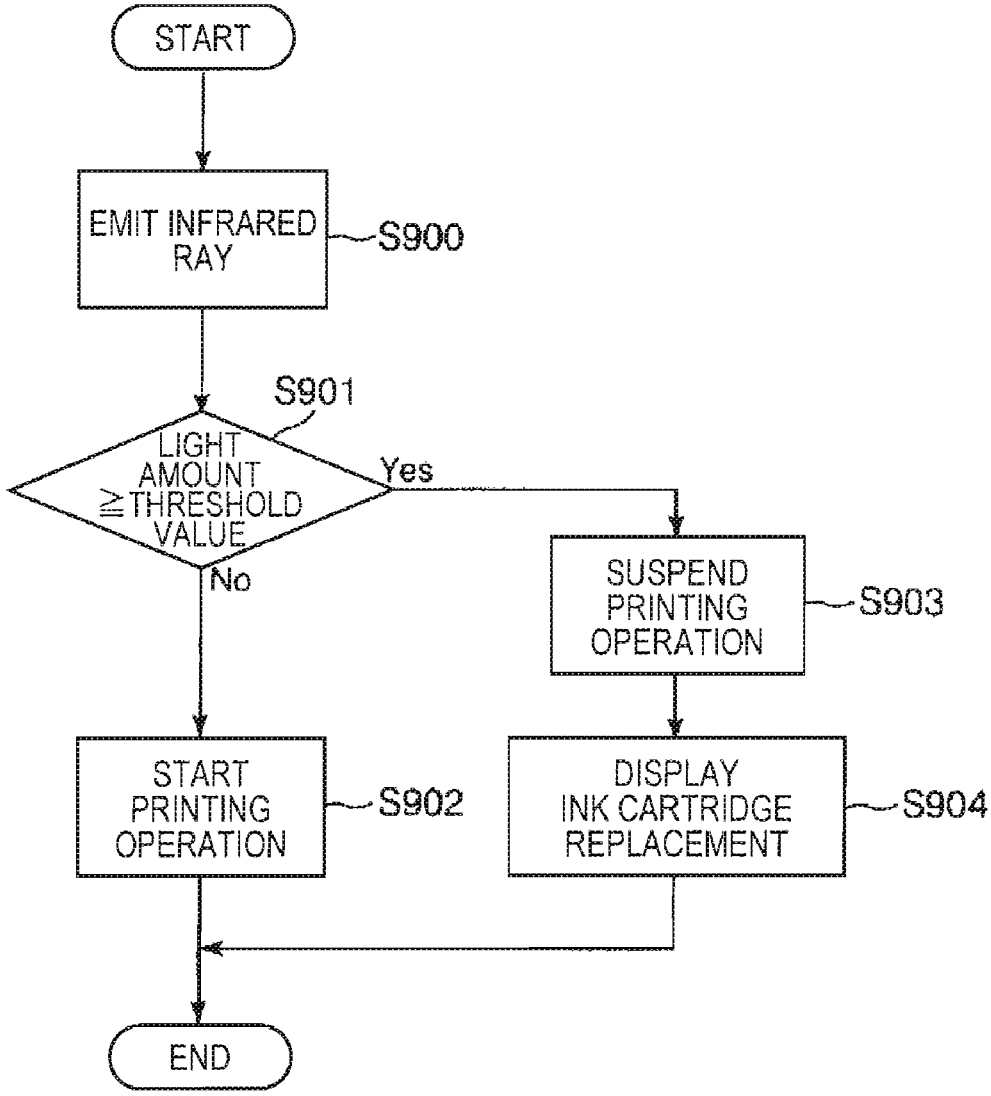
FIG. 8 is a flowchart showing a control program of a controller of the printing apparatus shown in FIG. 1.

FIG. 1 is a perspective view showing a printing apparatus according to a first embodiment of this invention. FIG. 2A is a perspective view showing an ink cartridge loaded into the printing apparatus shown in FIG. 1. FIG. 2B is a perspective view showing the ink cartridge loaded into the printing apparatus shown in FIG. 1. FIG. 3 is a cross-sectional view of the ink cartridge along the line A-A in FIG. 2A. FIG. 4A is a perspective view showing ink-cartridge-side terminals included in the ink cartridge shown in FIGS. 2A and 2B. FIG. 4B is a perspective view showing a terminal-integrated portion included in the ink cartridge shown in FIGS. 2A and 2B. FIG. 5 is a perspective view of a droplet discharging head of the printing apparatus shown in FIG. 1. FIG. 6 is a side view of the droplet discharging head shown in FIG. 5. FIG. 7 is a plan view of the droplet discharging head shown in FIG. 5. FIG. 8 is a flowchart showing a control program of a controller of the printing apparatus shown in FIG. 1. For convenience of explanation, hereinafter, terms, "upper" and "upward", indicate an upper side and terms, "lower" and "downward", indicate a lower side in FIGS. 1, 2A, and 3 to 6, respectively. The same goes for FIGS. 9 and 10. Furthermore, terms, "left" and "right", hereinafter indicate a left side and a right side respectively in FIGS. 1, 2B, 3, and 7.

A printing apparatus 100, i.e., a printer, shown in FIG. 1 performs printing to a recording medium 109 such as a paper, in a loaded state where the printing apparatus 100 is loaded with ink cartridges 1.

First, the ink cartridge will be explained.

The ink cartridge 1 shown in FIG. 2 has a cartridge body 2, sensors 8 mounted in the cartridge body 2, and a circuit board 6 serving as an electrode portion which is electrically connected to the sensors 8.

The cartridge body 2 has an outline in a flat shape. This cartridge body 2 is provided with a hollow, i.e., an inner cavity, which functions in the loaded state, as an ink supplying system 7 for supplying the ink to the printing apparatus 100. This ink supplying system 7 has a storage portion 71 for storing the ink, an outlet 72 for supplying the printing apparatus 100 with the ink in the loaded state, and a flow path 73 for guiding the ink from the storage portion 71 to the outlet 72.

A color of the ink to be filled in the ink supplying system 7 is not limited specifically and may be red, blue, yellow, black, or the like, for example. This ink is added with an infrared absorption material having a function of absorbing an infrared ray to distinguish the ink from other inks of the same color. That is, this ink has a higher infrared absorptivity than any other inks of the same color. The infrared absorption material is not limited specifically and may be a dye such as a phthalocyanine-based dye, a naphthalocyanine-based dye, an anthraquinone-based dye, an indolenine-based dye, a polymethine-based dye, a cyanine-based dye, a nitroso compound and a metal complex salt thereof, an azo cobalt, a thiol nickel salt, a triarylmethane-based dye, an immonium-based dye, a naphthoquinone-based dye, an anthraquinone-based dye, an anthracene-based dye, an azulene-based dye, or a phtlhalide-based dye, or an inorganic oxide such as an ITO (a thin doped indium oxide) or an ATO (an antimony doped tin oxide). An infrared ray L can be certainly absorbed by making the infrared absorption material of those materials as described above.

Furthermore, the cartridge body 2 is made of a substantially transparent resin material, which has an optical transparency. This resin material is not limited specifically and may be, for example, a polymethyl methacrylate resin (PMMA), a polycarbonate resin, an acrylic resin, or the like.

As shown in FIGS. 2 and 3, the storage portion 71 is composed of a first space 711 and a second space 712 in communication with the first space 711. When viewed from a side, i.e., from a direction of arrow B in FIG. 2A, the first space 711 is in a substantially rectangular or square shape. The second space 712 is situated at a lower side of the first space 711 and has a smaller rectangular shape than that of the first space 711 when viewed from a side.

As shown in FIG. 3, the flow path 73 is in communication with the vicinity of a bottom 713 of the storage portion 71. The flow path 73 is in a crank shape having a plurality of bends, e.g., three bends in this embodiment, in the middle of the flow path 73. More specifically, the flow path 73 in the loaded state as shown in FIG. 3 includes: a first horizontal path 731 extending in a substantially horizontal direction, i.e., a right direction in FIG. 3, from the vicinity of the bottom 713 of the storage portion 71; a first vertical path 732 extending in a substantially vertically upward direction, i.e., an upward direction in FIG. 3, frown a right end 731*a* of the first horizontal path 731; a second horizontal path 733 extending in a substantially horizontal direction, i.e., a right direction in FIG. 3, from an upper end 732*a* of the first vertical path 732; and a second vertical path 734 extending in a substantially vertically downward direction, i.e., a downward direction in FIG. 3, from a right end 733*a* of the second horizontal path 733 and reaching to the outlet 72.

The flow path 73 is shaped as described above, resulting in following advantages. When using the printing apparatus 100 in the loaded state, in the case where the printing apparatus 100 is placed at a location which is inclined to some extent with respect to the horizontal direction, the ink can be certainly guided from the storage portion 71 to the outlet 72 even where the amount of ink remaining in the ink supplying system 7 of the ink cartridges 1 decreases. Therefore, the ink inside the ink cartridge can be used up, i.e., run out.

It is to be noted that the number of the ink supplying system 7 provided to the ink cartridge 1 is one in the structure shown in FIGS. 2A and 2B but is not limited and may be two, for example, or more. In the case of the ink cartridge 1 provided with three ink supplying systems 7, these ink supplying system 7 allow red, blue, and yellow color inks to be fill therein, respectively.

A projection 22, which projects downward, is provide to a right side of a lower surface 21 of the cartridge 2, as shown in FIG. 2B. This projection 22 is provided with a hollow 221, in which the outlet 72 is open in a downward direction.

The ink cartridge 1 is mounted with a valve system 23 that opens and closes the outlet 72. The valve system 23 is composed of a valve disc 231, a sealing member 233, and a coil spring 232 urging the valve disc 231 in a downward direction, i.e., toward a side of the sealing member 233.

The sealing member 233 is mounted in the hollow 221 and has a ring shape along with an inner circumferential surface of the hollow 221. This sealing member 233 is made of an elastic material. The elastic material is not particularly limited but various rubber materials may be used as the elastic material, such as a natural rubber, an isoprene rubber, a butadiene rubber, a styrene-butadiene rubber, a nitrile rubber, a chloroprene rubber, a butyl rubber, an acrylic rubber, an ethylene-propylene rubber, a hydrin rubber, a urethane rubber, a silicon rubber, and a fluoro-rubber.

The valve disc 231 is mounted in the second vertical path 734 of the flow path 72 in a movable manner in a longitudinal direction of the second vertical path 734. This valve disc 231 has a disc-shaped portion 231*a* in a disc form and a guiding portion 231*b* provided to an upper surface of the disc-shaped portion 231*a* in a united manner. A lower surface of the disc-shaped portion 231*a* is brought in close contact with the sealing member 233 with urging force by the coil spring 232 in an unloaded state where the ink cartridge 1 is not loaded into the printing apparatus 100. Therefore, the ink is prevented from undesirably flowing out of the outlet 72. The guiding portion 231*b* slides over the inner circumferential surface of the second vertical path 734. Thus, the valve disc 231 is stably movable in the second vertical path 734 in a longitudinal direction thereof. A constituent material of the valve disc 231 is not limited and various metallic materials or plastics may be used in isolation or in combination.

In the loaded state, a hollow needle 36 connected to the droplet discharging head 101 of the printing apparatus 100 presses the disc-shaped portion 231*a* of the valve disc 231 against an urging force, thereby opening the outlet 72. Thus, the ink is supplied to the droplet discharging head 101 through an opening 361 formed in an outer circumferential surface of an upper end of the hollow needle 36.

An engaging piece 24 in a plate form is mounted in an upper portion of a periphery of the cartridge body 2. This engaging piece 24 is held in a manner that a lower end portion thereof is rotatable with respect to the periphery 25 of the cartridge body 2, as shown in FIG. 2B. The engaging piece 24 has a first projection 241 provided to a surface of the engaging piece 24 and two second projections 242 provided to a periphery.

As shown in FIG. 6, the first projection 241 of the engaging piece 24 is engaged in a first recess 38 in the loaded state, the first recess 38 provided to a loaded portion. i.e., a carriage, on which the ink cartridge 1 with the droplet discharging head 101 of the printing apparatus 100 is loaded in a detachable manner. Each of the second projections 242 is engaged in a second recess 37 in a loaded state, the second recess 37 provided to a loaded portion 107. This engagement prevents undesirable separation of the ink cartridge 1 from the loaded portion 107.

Furthermore, a guiding portion 27 in a plate form is provided in a projecting manner to a lower portion of the periphery 25 of the cartridge body 2. The guiding portion 27 is provided to the loaded portion 27 in the loaded state so as to be engaged in a third recess 39, i.e., a guiding groove for guiding the guiding portion 27. The ink cartridge 1 is thus positioned.

A recess 28 is provided in a concave manner to an upper portion of a periphery 26 on the other side of the periphery 25 of the cartridge body 2. The recess 28 is formed in size enough to allow a flat part of a thumb to fit therein, approximately.

A lower portion of the periphery 26 of the cartridge body 2 is provided with board-mounted portion 29 in a projecting manner, on which the circuit board 6 is mounted. As shown in FIG. 6, an upper surface 291 of the board-mounted portion 29 is engaged with, i.e., pressed against an engaging pin 40 in the loaded state, the engaging pin 40 provided to the loaded portion 107, made of an elastic material. This loaded state as described above prevents undesirable separation of the ink cartridge 1 from the loaded portion 107. Furthermore, the ink cartridge 1 is certainly positioned with respect to the loaded portion 107.

As shown in FIG. 4A, the circuit board 6, which is mounted on the board-mounted portion 29, is composed of a circuit body 61 and a plurality of terminals 62, i.e., ink-cartridge-side terminals, mounted on the circuit body 61.

The circuit body 61 is made of a plate-formed member in a substantial square shape.

As shown in FIG. 4A, each of the terminals 62 is disposed on a surface of the board body 61 in a hound's tooth check pattern. The terminals 62 are each in contact with terminals 41, i.e., apparatus-side terminals mounted on the loaded portion 107 of the printing apparatus 100 in the loaded state, as shown in FIG. 6. Therefore, a signal from a sensor 8 is transmittable to the printing apparatus 100 while a signal or a request from the printing apparatus 100 is transmittable to the sensor 8, in the loaded state. Furthermore, as shown in FIG. 4B, the terminals 69 are integrated by a terminal-integrated portion 63 on a backside of the circuit body 61, thereby being electrically connected to the sensor 8 through a conductor, i.e., a cable, not shown, which is connected to the terminal-integrated portion 63.

It is to be noted that a method for forming each of the terminals 62 to the board body 61 is not limited specifically and a printing method may be cited as an example. Each of the terminals 62 can be formed with high accuracy by the printing method, thereby being able to certainly come in contact with each of terminals 41 of the loaded portion 107 in the loaded state.

As shown in FIGS. 2A and 3, the cartridge body 2 is mounted with the sensor 8. The sensor 8 is composed of a light emitter 81 for emitting an infrared ray L and an light receiver 82 for receiving the infrared ray L emitted from the light emitter 81. The light emitter 81 and the light receiver 82 are disposed in opposition to each other with the second horizontal path 733 of the flow path 73 intervened therebetween in a longitudinal direction of the second horizontal path 733.

This disposition allows the infrared ray L to be certainly emitted from the light emitter 81 to the second horizontal path 733 of the ink supplying system 7. Furthermore, the infrared ray L having been emitted from the light emitter 81 passes through the second horizontal path 733 in a longitudinal direction thereof to be certainly received by the light receiver 82.

Where the ink exists in the second horizontal path 733, certain emission and reception of the infrared ray L as described above ensures that the infrared absorption material mixed into the ink absorbs the infrared ray L, thereby decreasing the light amount of the infrared ray L which is received by the light receiver 82. Where the ink does not exist in the second horizontal path 733, the light amount of the infrared ray L which is received by the light receiver 82 is substantially equal to the light amount of the infrared ray L emitted by the light emitter 81.

Disposition of the sensor 8 as described above results in an optical path between the light emitter 81 and the light receiver 82 in a longitudinal direction of the second horizontal path 733. Accordingly, where the ink exists in the second horizontal path 733, the infrared absorption material mixed into the ink certainly absorbs the infrared ray L, thereby decreasing the light amount of the infrared ray L received by the light receiver 82.

Furthermore, the infrared ray L emitted by the light emitter 81 has a peak wavelength, i.e., a maximum wavelength desirably set to 750 to 1500 nm and more desirably set to 800 to 1300 nm. Thus, the infrared absorption material mixed into the ink absorbs the infrared ray L certainly.

The printing apparatus 100 will be described next. As shown in FIG. 1, in the printing apparatus 100, the droplet discharging head 101 is installed on an lower side of the loaded portion 107. This droplet discharging head 101 is guided by a guiding axis 102, thereby being moved along a belt 103 in association with a carriage motor 104 in an arrow direction, i.e., a longitudinal direction of the guiding axis 102. The droplet discharging head 101 discharges as a droplet the ink having been supplied from the ink cartridge 1 which is loaded into the loaded portion 107.

In the printing apparatus 100 as described above, the recording medium 109 is conveyed by a paper conveyance roller and a paper pressing roller, both not shown, thereby passing under the droplet discharging head 101. At this time, the recording medium 109 is printed with ink droplets discharged from the droplet discharging head 101 and then discharged from the printing apparatus 100 by a discharging roller, not shown.

As shown in FIGS. 5 and 7, the loaded portion 107 is loadable with four ink cartridges 1. Starting from the right in FIG. 7, red, blue, yellow, and block inks are filled in the ink cartridges, respectively.

A backside of the loaded portion 107, i.e., a right side in FIG. 6, is provided with recesses 31, 32. Each of the recesses 31, 32 is formed in a direction of disposition of four ink cartridges 1. The guiding axis 102 is inserted in the recess 31. A guiding portion, not shown, which is formed near the guiding axis 102 in a projecting manner in parallel with the guiding axis 102, is inserted in the recess 32. Thus, the loaded portion is certainly slidable, i.e., movable along with the guiding axis 102 and the guiding portion. As a result, the printing operation can be performed with stability to the recording medium 109 using the droplet discharging head 101.

Furthermore, the loaded portion 107 is provided with a plurality of ribs 33, 34 in a projecting manner, the ribs 33, 34 partitioning the adjacent ink cartridges 1. The ribs 33 are to partition the ink cartridges 1 at a side of the engaging pieces 24, respectively. The ribs 34 are to partition the ink cartridges 1 at a side of the board-mounted portions 29.

Formation of these ribs 33, 34 makes it easy for a user to perform the operation to attach or detach each of the ink cartridges 1 with respect to the loaded portion 107 since side surfaces of the ink cartridges 1 are guided by the ribs 33, 34, respectively.

As shown in FIG. 3, a controller 105 is built into the printing apparatus 100, the controller 105 electrically connected to each of the terminals 41 at the loaded portion 107. The controller 105 is composed of a CPU (Central Processing Unit) and a memory, i.e., a memorizing unit. The memory includes a storage medium, i.e., a recording medium, which stores or records programs or data and is readable by the CPU. This recording medium is composed of a magneto-optical recording medium such as a RAM (Random Access Memory) including both volatile and nonvolatile memories, an FD (Floppy Disk®), an HD (Hard Disk), or a CD-ROM (Compact Disc Read-Only Memory), or a semiconductor memory. The controller 105 with this structure has a function of controlling the printing operation, i.e., a droplet discharging operation of the droplet discharging head 101.

Furthermore, the printing apparatus 100 has a display unit 106 as a reporting unit for displaying, i.e., for reporting exchange of the ink cartridge 1 or information relating thereto. This display unit 106 may be composed of a liquid crystal panel, for example.

Where the veritable ink cartridges 1, i.e., the genuine ink cartridge 1, which is filled with the ink mixed with the aforementioned infrared absorption material, the ink referred to as a proper ink hereinafter, is loaded into the loaded portion 107, the printing apparatus 100 with the structure as described above performs a regular printing, i.e., a normal printing in which the printing is performed to the recording medium 109 using ink droplets discharged by the droplet discharging heads 101.

The aforementioned regular printing is performed in the case where the controller makes a judgment that use of the ink is adequate as a result of a judgment as to the adequacy of use of the ink inside the ink cartridge 1 based on the information from the sensor 8 of the ink cartridge 1.

Furthermore, where the regular printing is performed, the ink is consumed over time and eventually, the amount of remaining ink reaches to approximately zero, for example, which is not enough to perform the regular printing. In other words, the ink cartridge 1 becomes empty of ink. In this case, the regular printing can be performed as long as the used ink cartridge 1 in empty state is replaced with the unused ink cartridge 1.

However, it can be considered that a malicious user fills or pumps through the outlet 72 a fake ink unmixed with the infrared absorption material, the fake ink hereinafter referred to as a counterfeit ink, in the used ink cartridge 1 in later phase. In the case of loading the ink cartridge 1 filled with the counterfeit ink, hereinafter refereed to as the counterfeit ink cartridge, into the loaded portion 107, the controller 105 of the printing apparatus 100 makes a judgment that use of the ink is inadequate, thereby prohibiting the printing operation. Thus, reuse of the ink cartridge 1 can be certainly prevented.

As described above, the judgment as to adequacy of use of the ink is made based on the information from the sensor 8. The information from the sensor 8 is not limited specifically and the light amount of the infrared ray L received by the light receiver 8 is used as the information in this embodiment.

Where the proper ink exists in the second horizontal path 733 of the ink cartridge 1, the infrared absorption material mixed into the proper ink certainly absorbs the infrared ray L emitted by the light emitter 81, thereby decreasing the light amount of the infrared ray L received by the light receiver 82 compared to the light amount of the infrared ray L emitted by the light emitter 81.

Where the fake ink exists in the second horizontal path 733 of the ink cartridge 1, the infrared ray L emitted by the light emitter 81 is not absorbed, as described above. Thus, the light amount of the infrared ray L received by the light receiver 82 is substantially equal to the light amount of the infrared ray L emitted by the light emitter 81.

Hereinafter, the control program of the controller 105 of the printing apparatus will be described based on the flowchart in FIG. 8.

Where the printing apparatus 100 starts the printing operation, the light emitter 81 emits the infrared ray at the step S900.

A judgment is made at the step S901 as to whether the light amount of the infrared ray L received by the light receiver 82 is greater than or equal to a threshold value as a predetermined value previously stored or set in the memory of the controller 105. In the case of judgment that the light amount is not greater than nor equal to the threshold value, that is, the light amount is smaller than the threshold value, which means that the ink inside the ink cartridge 1 is the proper ink suitable for printing use, the operation for regular printing is performed at the step S902.

In the case of judgment that the light amount is greater than or equal to the threshold value, which means that the ink inside the ink cartridge 1 is the counterfeit ink unsuitable for printing use, the printing operation is prohibited at the step S903.

Next, the display unit 106 displays a status message, "Exchange Ink Cartridge (With Genuine Ink Cartridge)", at the step S904.

The structure as described above enables the printing apparatus 100 to prevent use of the used ink cartridge in later phase by pumping the counterfeit ink unsuitable for the ink cartridge into the used ink cartridge. In other words, the printing apparatus 100 can prevent reuse of the used ink cartridge by adopting the structure as described above.

It is to be noted that prohibition of a droplet discharging operation of the droplet discharging head 101 or a conveyance operation, i.e., paper conveyance operation for conveying the recording medium 109 may be cited as prohibition of the printing operation.

Where the regular printing is performed, the proper ink is consumed over time and eventually runs out in the second horizontal path 733. That is, in this state, the infrared absorption material does not absorb the infrared ray L any more. At this time, the light amount of the infrared ray L received by the light receiver 82 reaches to the threshold value. Where the light amount reaches the threshold value, the number of discharged ink droplet, i.e., the number of print dots, is counted. The printing operation is suspended where the number of discharged droplets, that has been counted, reaches to the number of dischargeable ink droplets, i.e., the predetermined dot number such that the proper ink remaining inside the ink cartridge 1 becomes substantially equal to zero, which is calculated based on the amount or volume of the proper ink remaining inside the ink cartridge 1 and a volume per ink droplet.

With the controlling structure as described above, the proper ink can be certainly used up, i.e., run out.

It is to be noted that the number of dischargeable ink droplets as described above is previously stored in the memory of the controller 105.

Furthermore, where the printing operation is suspended, as described above, the display unit 106 may display a status message, "Exchange Ink Cartridge (With Genuine Ink Cartridge)". Accordingly, an exchange timing of the ink cartridge 1 can be ascertained.

The printing apparatus 100 may include a current detector for detecting a weak current from the sensor 8. Where the proper ink is filled in the ink cartridge 1, the current of the corresponding light amount, i.e., the light amount received by the light receiver 82, may be defined as the aforementioned weak current.

Where a malicious user insulates or crushes at least either one side of the terminals 62 at a side of the ink cartridge 1 and the terminals 41 at a side of the printing apparatus 100, the current from the sensor 8 becomes zero, the controller 105 makes a judgment that the ink inside the ink cartridge 1 is a proper ink suitable for printing, regardless the proper ink or the counterfeit ink.

However, operation of the current detector allows detection of the weak current from the sensor 8, thereby making a judgment more reliable as to adequacy of use of the ink.

Conditions for, e.g., a content of the infrared ray absorption material or construction material, or a peak wavelength of the infrared ray L emitted by the light emitter 81 may be changed according to a manufacture period of the in cartridge 1. Thus, the manufacture period, in other words, a manufacture record of the ink cartridge 1 can be managed.

Second Embodiment

Figure 9:
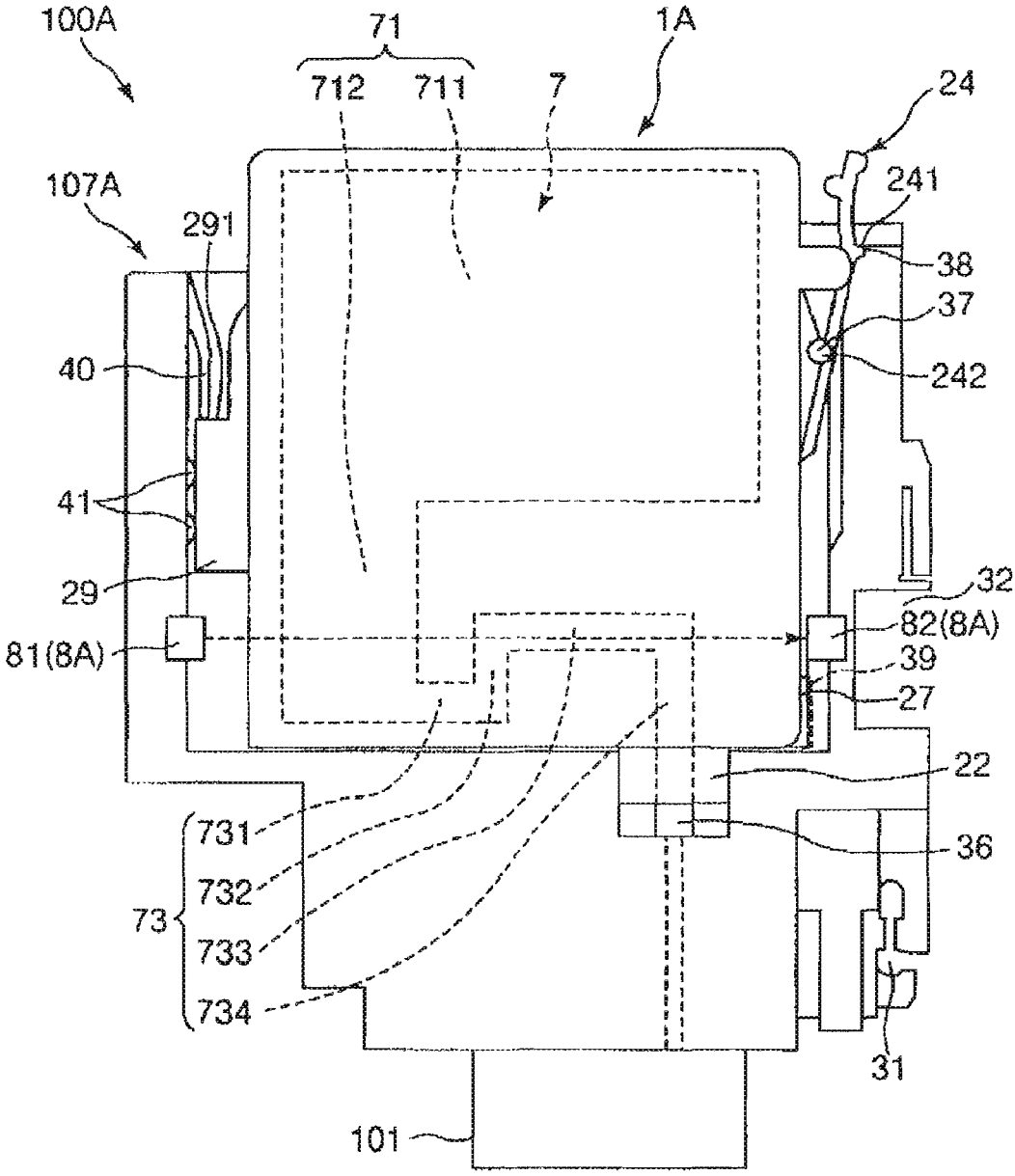
FIG. 9 is a side view of a droplet discharging head of a printing apparatus according to a second embodiment of this invention.

FIG. 9 is a side view of the droplet discharging head of a printing apparatus according to a second embodiment of this invention.

The printing apparatus according to the second embodiment of this invention will be described hereinafter with reference to FIG. 9, in which differences between the first and the second embodiments are mainly described and description for similar matters therebetween is omitted.

This embodiment and the first embodiment are the same except that the sensor is mounted in the printing apparatus.

As shown in FIG. 9, a loaded portion 107A of a printing apparatus 100A is mounted with a sensor 8A which has substantially the same structure as that of the sensor 8 mounted in the ink cartridge 1 in the first embodiment. An ink cartridge 1A loaded into the loaded portion 101A is substantially the same as that of the ink cartridge 1 in the first embodiment except that the sensor described in the first embodiment is omitted.

Each of the sensors 8A is composed of the light emitter 81 disposed at a side of the terminal 41 of the loaded portion 107A, i.e., a left side in FIG. 9, and the light receiver 82 disposed in opposition to the light emitter 81 at a side of the third recess 39 of the loaded portion 107A, i.e., a right side in FIG. 9. Each of the light emitter 81 and the light receiver 82 are electrically connected to the controller 105 of the printing apparatus 100A.

In the loaded state, the second horizontal path 733 of the flow path 72 in the ink supplying system 7 of the ink cartridge 1A is intervened between the light emitter 81 and the light receiver 82. Thus, the optical path of the infrared ray L between the light emitter 81 and the light receiver 82 extends in a longitudinal direction of the second horizontal path 733. As a result, where the ink exists in the second horizontal path 733, the infrared absorption material mixed into the ink certainly absorbs the infrared ray L thereby decreasing the light amount of the infrared ray L received by the light receiver 82 more certainly. Furthermore, the ink does not exist in the second horizontal path 733, the light amount of the infrared ray L received by the light receiver 82 is substantially equal to the light amount of the infrared ray L emitted by the light emitter 81.

The structure as described above allows the printing apparatus 100A to perform substantially the same operation as that of the printing apparatus 100 according to the first embodiment. Therefore, this structure enables the printing apparatus 100A to prevent use of the used ink in later phase by pumping the counterfeit ink unsuitable for the ink cartridge into the used ink cartridge. In other words, the printing apparatus 100A can prevent reuse of the used ink cartridge by adopting the structure as described above.

Figure 10:
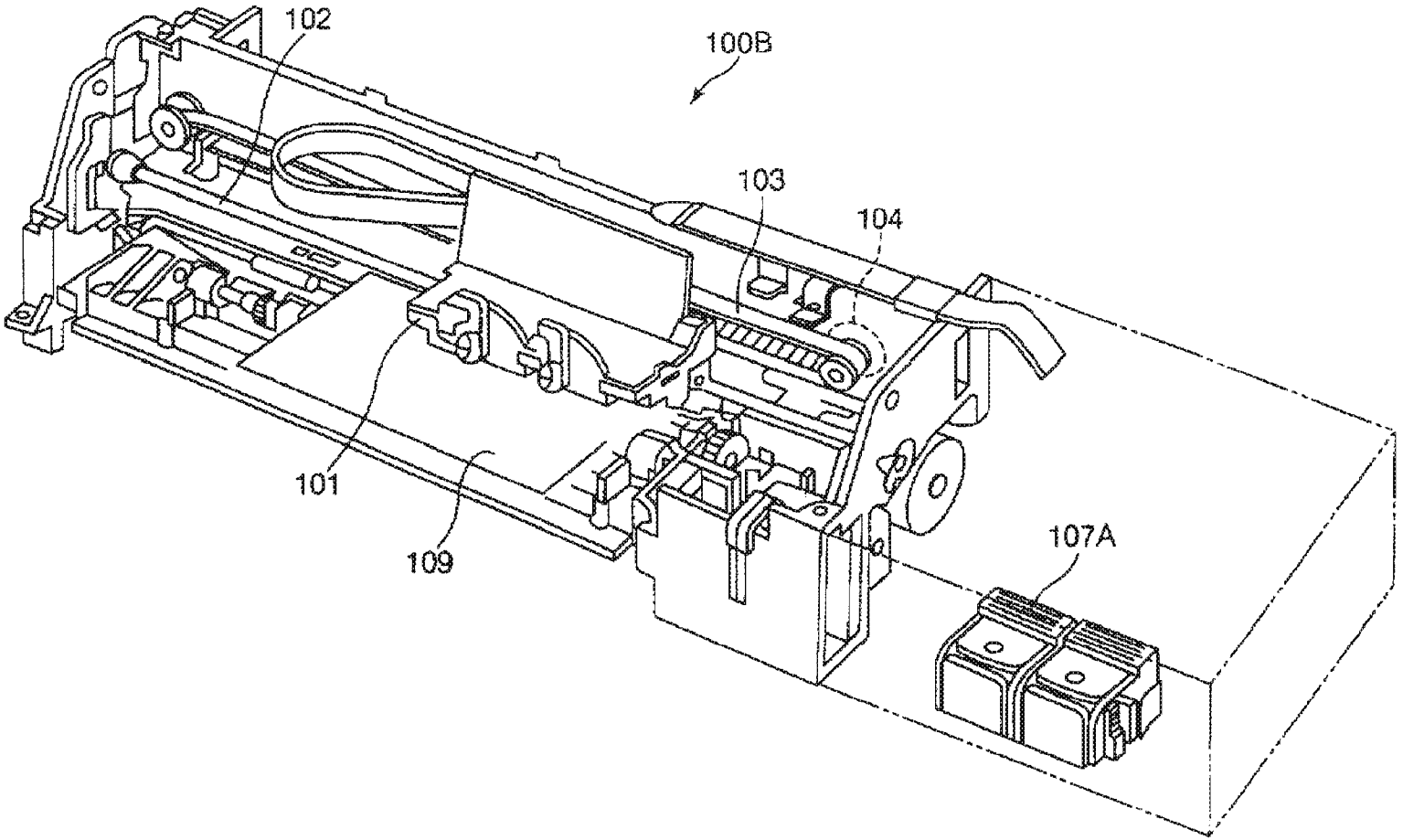
FIG. 10 is a perspective view showing a printing apparatus according to a third embodiment of this invention.

FIG. 10 is a perspective view showing a printing apparatus according to a third embodiment of this invention.

The printing apparatus according to the third embodiment of this invention will be described hereinafter with reference to FIG. 10, in which differences between the aforementioned embodiments and the third embodiment are mainly described and description for similar aspects therebetween is omitted.

This embodiment and the second embodiment are the same except that the loaded portion is mounted in a fixed manner.

A printing apparatus 100B shown in FIG. 10 is mounted with the loaded portion 107A in a fixed manner. In other words, the loaded portion 107A is not moved along the guiding axis 102.

The droplet discharging head 101 is movable along the guiding axis 102. The droplet discharging head 101 is connected through a tube, not shown, to the loaded portion 107A. As a result, the ink can be supplied from the ink cartridge 1A loaded into the loaded portion 107A through the tube to the droplet discharging head 101.

The ink cartridges and the printing apparatuses according to the embodiments of the invention, shown in drawings are described above but this invention is not limited thereto. Each of elements composing the ink cartridge and the printing apparatus may be substituted by an element with an arbitral structure which allows similar functions to be fully used. Furthermore, arbitral constituents may be added.

Yet further, each of the ink cartridge and the printing apparatus according to this invention may be a combination of two or more arbitral structures. i.e., features of the aforementioned embodiments.

For example, the loaded portion described in the first embodiment may be mounted in a fixed manner in a manner similar to the loaded portion according to the third embodiment.

What is claimed is:

1. An ink cartridge comprising:

an ink added with an infrared absorption material, filled in the ink cartridge;

an ink supplying system including:

a storage portion for storing the ink;

an outlet for supplying the ink to a printing apparatus for performing printing in a loaded state where the ink cartridge is loaded in the printing apparatus; and a flow path for guiding the ink from the storage portion to the outlet, a light emitter;

a sensor including a light receiver disposed in opposition to the light emitter with the ink supplying system intervened therebetween, the light receiver for receiving a transmitted light resulting from transmission of an emitted light from the light emitter through the ink supplying system; and an ink cartridge-side terminal electrically connected to the sensor, coming in contact with an apparatus-side terminal provided to the printing apparatus in the loaded state, wherein:

the infrared absorption material has a function of absorbing an infrared ray to distinguish the ink from another ink of a same color;

the ink cartridge is used in the loaded state; and the emitted light has a wavelength in an infrared range.

2. The ink cartridge according to claim 1, wherein the light emitter and the light receiver are disposed in opposition to each other with one part of the flow path intervened therebetween.

3. The ink cartridge according to claim 1, wherein an optical path of the emitted light between the light emitter and the light receiver extends in a longitudinal direction of the flow path.

4. The ink cartridge according to claim 1, wherein the flow path has at least one bend in a middle thereof.

5. The ink cartridge according to claim 1, wherein the outlet is open in a downward direction in the loaded state, and wherein the flow path includes in the loaded state, a first horizontal path extending in a substantially horizontal direction from a vicinity of a bottom of the storage portion, a first vertical path extending in a substantially vertically upward direction from an end of the first horizontal path, a second horizontal path extending in a substantially horizontal direction from an upper portion of the first vertical path, and a second vertical path extending in a substantially vertically downward direction from an end of the second horizontal path up to the outlet.

6. The ink cartridge according to claim 5, wherein the light emitter and the light receiver are disposed in opposition to each other with the second horizontal path intervened therebetween in a longitudinal direction of the second horizontal path.

7. The ink cartridge according to claim 1, wherein the emitted light has a peak wavelength within 750 to 1500 nm.

8. The ink cartridge according to claim 1, wherein the infrared absorption material includes as a main material at least one kind of a phthalocyanine-based dye, a naphthalocyanine-based dye, and an anthraquinone-based dye.

9. A printing apparatus for performing printing in a loaded state where the printing apparatus is loaded with the ink cartridge according to claim 1, the printing apparatus comprising:

a loaded portion loaded with the ink cartridge, including an apparatus-side terminal in contact with an ink cartridge-side terminal in the loaded state;

a droplet discharging head for discharging as a droplet the ink supplied from the ink cartridge in the loaded state; and a controller electrically connected to the apparatus-side terminal, the controller having a function of controlling a droplet discharging operation of the droplet discharging head, wherein:

the controller makes judgment as to adequacy of use of the ink inside the ink cartridge based on information form the sensor; and the controller prohibits printing operation in the case of the judgment that the use of the ink is inadequate.

10. The printing apparatus according to claim 9, wherein the controller makes the judgment as to adequacy of the use of the ink inside the ink cartridge according to the light amount of the transmitted light received by the light receiver.

11. The printing apparatus according to claim 10, wherein the controller controls to prohibit the printing operation where the light amount is greater than or equal to a predetermined value previously set.

12. The printing apparatus according to claim 10, wherein the controller controls to perform the printing operation where the light amount is smaller than the predetermined value.

13. The printing apparatus according to claim 12, wherein the controller counts the number of print dots where the light amount reaches to the predetermined value.

14. The printing apparatus according to claim 13, wherein the controller controls to suspend the printing operation where the counted number of the print dots reaches the predetermined number of dots previously set.

15. The printing apparatus according to 9, further comprising a reporting unit for reporting exchange of the ink cartridge in the case of prohibition or suspension of the printing operation.

* * * * *

Disclaimer 7,918,549—Kazuhiko Amano, Shibuya-ku, JP; Naoyuki Toyoda, Suwa, JP; Hiroyuki Hara Chino, JP, Takayuki Kondo Suwa, JP. INK CARTRIDGE AND PRINTING APPARATUS. Patent dated April 05, 2011. Disclaimer filed Jan. 07, 2011, by the assignee, Seiko Epson Corporation.

The term of this patent shall not extend beyond the expiration date of Pat. No. 7758175 B2.

(*Official Gazette* May 24, 2011)